United States Patent [19]

Santo

[11] 4,279,455

[45] Jul. 21, 1981

[54] DRAWER ASSEMBLY

[76] Inventor: Philip J. Santo, 3750 Monroe Ave., Pittsford, N.Y. 14534

[21] Appl. No.: 115,063

[22] Filed: Jan. 24, 1980

[51] Int. Cl.[3] ..... A47B 88/02; A47B 47/00

[52] U.S. Cl. ..... 312/330 R; 312/140; 312/263

[58] Field of Search ..... 312/140, 257 R, 263, 312/330, 195; 403/187, 235, 237; 217/12

[56] References Cited

U.S. PATENT DOCUMENTS

| | | | |
|---|---|---|---|
| 3,822,924 | 7/1974 | Lust | 312/263 |
| 4,021,087 | 5/1977 | Ferguson | 312/263 |
| 4,036,542 | 7/1977 | Courtwright | 312/330 R |
| 4,191,439 | 3/1980 | Cohen | 312/330 R |

FOREIGN PATENT DOCUMENTS

| | | | |
|---|---|---|---|
| 564819 | 7/1957 | Italy | 312/330 |

*Primary Examiner*—Casmir A. Nunberg
*Attorney, Agent, or Firm*—Lawrence P. Kessler

[57] ABSTRACT

A furniture drawer of knock-down construction. The furniture drawer comprises front, side, rear, and bottom panels. The front panel has vertical, spaced apart, grooves of female dove-tail configuration in the inner face adjacent and parallel to the vertical marginal edges, and a groove in its inner face adjacent and parallel to the lower marginal edge. A pair of side panels respectively have one marginal edge of male dove-tail construction adapted to be received in the respective vertical grooves of the front panel. The side panels additionally have a groove in their respective inner faces adjacent and parallel to the opposite vertical marginal edge and a groove adjacent and parallel to their lower marginal edge. The rear panel has a groove in the inner face adjacent and parallel to its lower marginal edge, and a pair of grooves in the inner face adjacent and parallel to its vertical marginal edges. The bottom panel is adapted to be received within the respective grooves adjacent and parallel to the lower marginal edges of the front, side, and rear panels. The side panels are secured to the rear panel on assembly by retainers respectively including a pair of first members connected along a marginal edge and extending from one another at substantially a right angle, and a pair of second members connected along a marginal edge and extending from one another at substantially a right angle. The first members and second members are connected to form panel receiving channels therebetween. Tabs on the second members extend toward respective first members and are respectively adapted to be received in the grooves adjacent and parallel to the vertical marginal edges of the side and rear panels.

8 Claims, 4 Drawing Figures

DRAWER ASSEMBLY

BACKGROUND OF THE INVENTION

This invention relates generally to furniture drawer construction, and more particularly to a furniture drawer assembly of the knock-down type.

With the furniture industry being faced with ever escalating shipping and storage costs, there has been a move toward knock-down furniture construction. Furniture of knock-down construction can be compactly packaged for shipping and storage while being relatively quickly and easily reassembled when the furniture is to be reused. Although knock-down construction techniques are readily applicable to drawers, drawers of such construction have displayed a lack of sturdiness when compared to conventional construction techniques. Further, such drawers have used conventional fasteners which are both unattractive and unacceptable to customers looking for quality furniture construction (e.g., dove-tail construction). Moreover, resssembly of the drawers with conventional fasteners increases labor cost, thus negating at least a portion of the costs saved on shipping and storage.

One recent knock-down drawer construction has attempted to simplify reassembly by using flexible clamps (see U.S. Pat. No. 4,036,542, issued July 19, 1977 in the name of Courtwright). However, the clamps of the drawer of this patent for securing the front panel to the side panels are attached to the front panel by conventional fasteners in a manner which is not favored by quality-seeking customers. Furthermore, the side panels require accurate machining of the clamp-receiving grooves and panel edges to enable the side panels to be assembled to the rear panel; and the configuration of the rear clamps does not provide structural sturdiness (i.e., the side and rear panels can readily be flexed outwardly to the point where the drawer will come apart).

SUMMARY

It is the purpose of this invention to provide a furniture drawer of knock-down construction which is readily assembled, sturdy, and exhibits customer favored quality construction. The furniture drawer comprises front, side, rear, and bottom panels. The front panel has vertical, spaced apart, grooves of female dove-tail configuration in the inner face adjacent and parallel to the vertical marginal edges, and a groove in its inner face adjacent and parallel to the lower marginal edge. A pair of side panels respectively have one marginal edge of male dove-tail construction adapted to be received in the respective vertical grooves of the front panel. The side panels additionally have a groove in their respective inner faces adjacent and parallel to the opposite vertical marginal edge and a groove adjacent and parallel to their lower marginal edge. The rear panel has a groove in the inner face adjacent and parallel to its lower marginal edge, and a pair of grooves in the inner face adjacent and parallel to its vertical marginal edges. The bottom panel is adapted to be received within the respective grooves adjacent and parallel to the lower marginal edges of the front, side, and rear panels. The side panels are secured to the rear panel on assembly by retainers respectively including a pair of first members connected along a marginal edge and extending from one another at substantially a right angle, and a pair of second members connected along a marginal edge and extending from one another at substantially a right angle. The first members and second members are connected to form panel receiving channels therebetween Tabs on the second members extend toward respective first members and are respectively adapted to be received in the grooves adjacent and parallel to the vertical marginal edges of the side and rear panels.

BRIEF DESCRIPTION OF DRAWINGS

In the detailed description of the preferred embodiment of the invention presented below, reference is made to the accompanying drawings, in which.

DESCRIPTION OF PREFERRED EMBODIMENT

Figure 1:
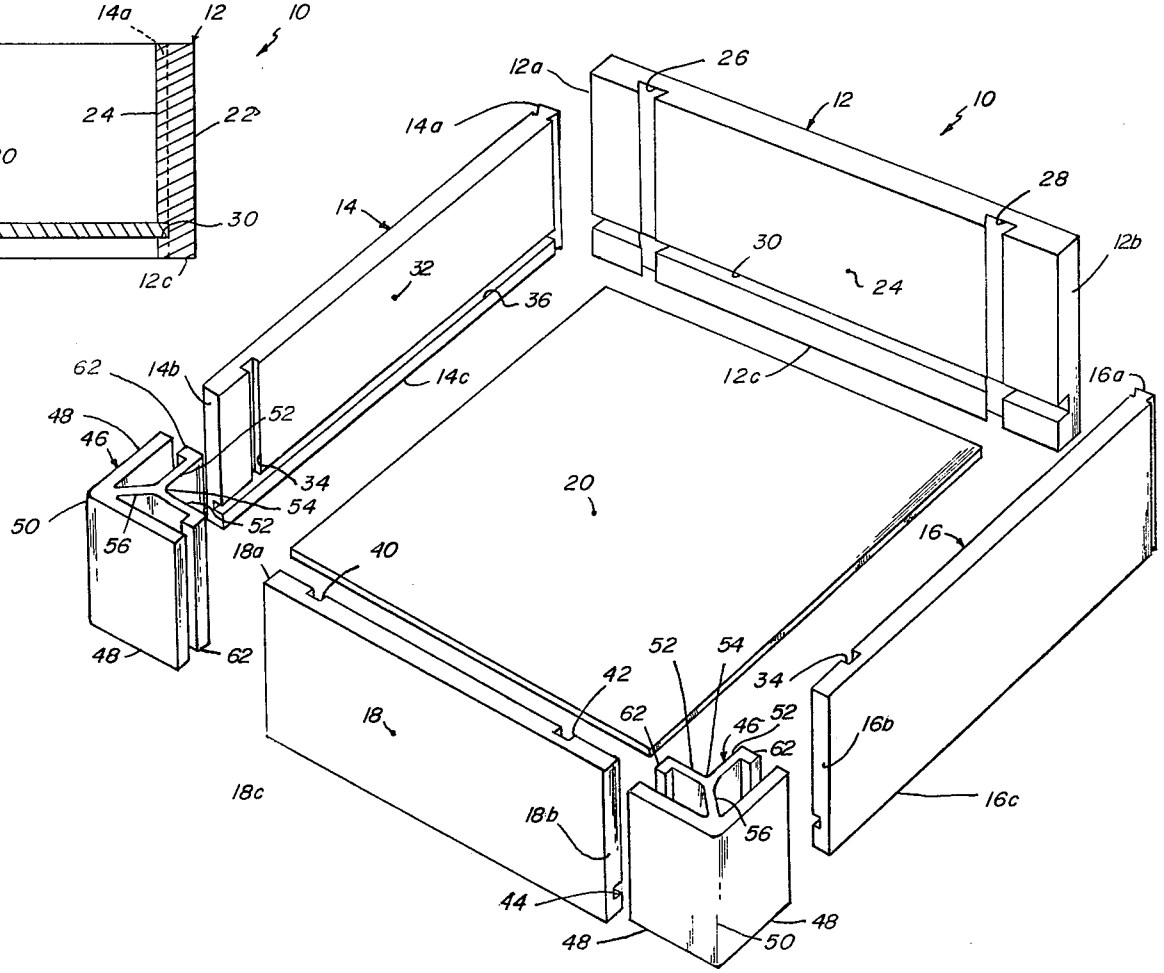
FIG. 1 is an exploded view, in perspective, of the furniture drawer of knock-down construction according to this invention.

Referring now to the drawings, FIG. 1 shows the elements of a furniture drawer of knock-down construction according to this invention. The drawer, designated generally by the numeral 10, includes a front panel 12, a pair of side panels 14 and 16, a rear panel 18, and a bottom panel 20. The panels may be made of wood or pressboard, for example. The front panel 12 has an outer face 22 and an inner face 24. The outer face 22 is decorated in any particular furniture style, such as by being covered with a veneer of a selected style. The inner face 24 has a pair of vertical spaced-apart grooves 26, 28 of female dove-tail configuration. The grooves 26 and 28 are adjacent and parallel to the vertical marginal edges 12*a*, 12*b* of the front panel 12. The inner face 24 also has a groove 30 adjacent and parallel to the lower marginal edge 12*c*.

The side panels 14 and 16 have respective vertical marginal edges 14*a*, 16*a* of male dove-tail configuration. The edges 14*a* and 16*a* are complimentary to the femal dove-tail configuration of the grooves 26, 28. The inner face 32 of each side panel has a groove 34 adjacent and parallel to the opposite vertical marginal edge, and a groove 36 adjacent and parallel to the lower marginal edge. Similarly, the inner face 38 of the rear panel 18 has a pair of grooves 40, 42 adjacent and parallel to the vertical marginal edges 18*a*, 18*b*, and groove 44 adjacent and parallel to the lower marginal edge 18*c*. The respective grooves may be simply formal by routing, for example.

Figure 4:
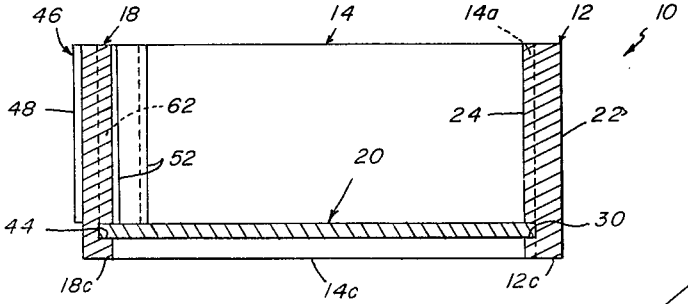
FIG. 4 is a side elevational view, in cross-section, of the assembled furniture drawer of FIG. 1.
Figure 2:
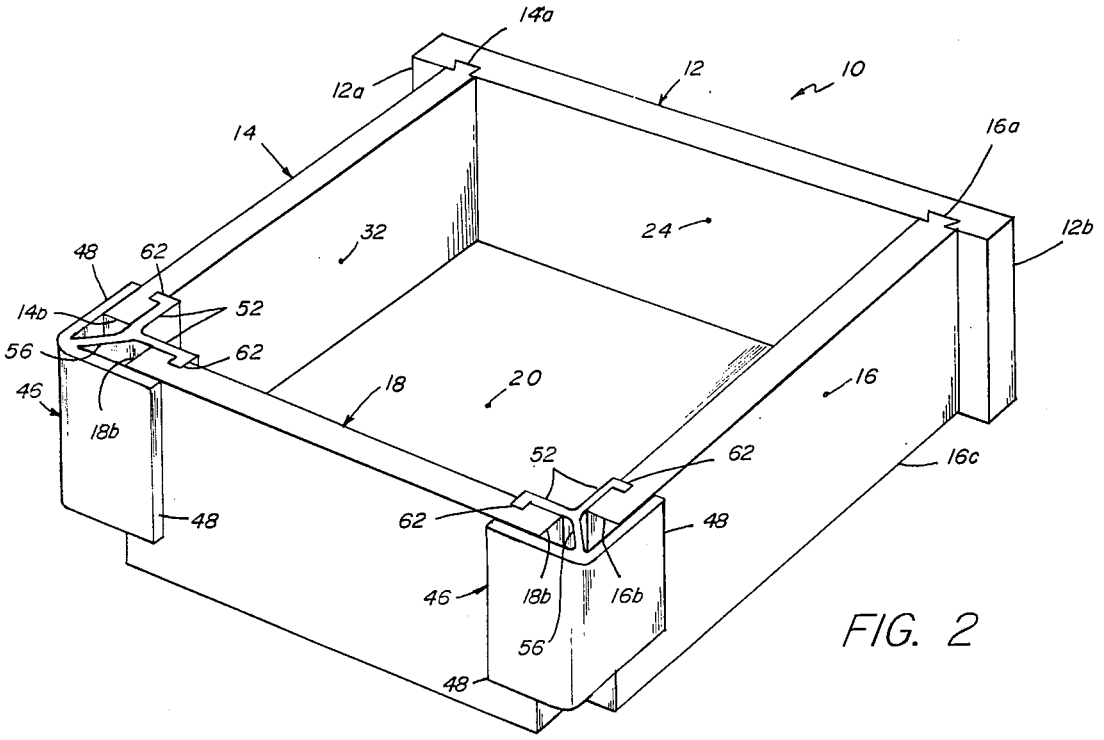
FIG. 2 is a view, in perspective, of an assembled furniture drawer of FIG. 1.
Figure 3:
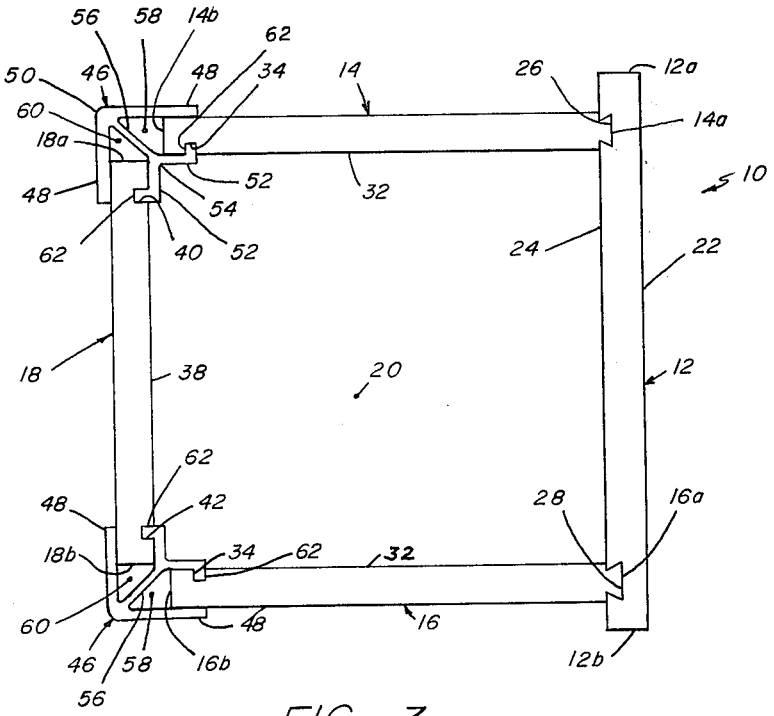
FIG. 3 is a top plan view of the assembled furniture drawer of FIG. 1.

When the drawer 10 is assembled as shown in FIGS. 2 through 4, the male dove-tail configured edges 14*a*, 16*a* are respectively received in the female dove-tail configured grooves 26, 28 to connect the side panels 14 and 16 to the front panel 12. The use of the dove-tail configuration (universally recognized as a quality construction expedient) is readily visible when viewing the drawer 10 from the top (as in FIG. 3). The interconnection between the side panels and the front panel can be made permanent, such as by placing a bonding cement in the grooves 26, 28, or can remain relatively movable so that the drawer can be readily disassembled.

The bottom panel 20 is received in the grooves 30, 36, and 44 and is held in position when the rear panel 18 is secured to the side panels 14 and 16 by retainers 46. The retainers 46 are of a resilient material, such as extruded plastic, for example. Each of the retainers has a pair of first members 48 connected along a marginal edge 50 and extending from one another at substantially a right angle, and a pair of second members 52 connected along a marginal edge 54 and extending from one another at substantially a right angle. An elongate web 56 is connected to the marginal edges 50 and 54 to interconnect the pair of first members and the pair of second members. The web 56 maintains a spacing between the members to form respective panel receiving channels 58, 60 therebetween. The length of the web is selected such that the channels are equal to or less than the thickness of the panels. Thus, the resilient material of the retainers acts against the faces of the panels to secur the panels in the channels.

The second members 52 have elongate tabs 62 extending toward the respective first members 48. Preferably, the tabs 62 are integral with marginal edges 52*a* of the second members 52. To accomplish the securing of the rear panel 18 to the side panels 14 and 16, the tabs 62 of retainers 46 are aligned with grooves 34, 40, and 42 and the retainers are slipped over the marginal edges 14*b*, 16*b*, 18*a*, and 18*b*. The side and rear panels are thus received in the channels 58 and 60. The resilience of the retainer acting on the panels and the location of the tabs 62 in the grooves 34, 40, and 52 effectively clamp the rear panel to the side panels to form a ridged structure for the drawer 10. However, the drawer can be readily disassembled by simply slipping the retainers from the panels. As can best be seen in FIG. 3, since the panels are received in channels 58 and 60, it is not required that the rear panel engage the side panels when the drawer 10 is assembled. Accordingly, the marginal edges 14*b*, 16*b*, 18*a*, and 18*b* do not require accurate machining; and the tolerance between the marginal edges and their respective grooves 34, 40, and 52 is not substantially critical.

The invention has been described in detail with particular reference to a preferred embodiment thereof, but it will be understood that variation and modification can be effected within the spirit and scope of the invention as claimed hereinbelow.

I claim:

1. A furniture drawer of knock-down construction comprising:

a front panel having an outer face and an inner face, spaced apart grooves of female dove-tail configuration defined in said inner face adjacent and parallel to the vertical marginal edges of said front panel, and a groove defined in said inner face adjacent and parallel to the lower marginal edge of said front panel;

a pair of side panels having an outer face and an inner face, one vertical marginal edge of each respective side panel having male dove-tail configuration adapted to be received in a respective said spaced apart groove of said front panel, a groove defined in said inner face of each respective side panel adjacent and parallel to the opposite vertical marginal edge thereof, and a groove defined in said inner face of each respective side panel adjacent and parallel to the lower marginal edge thereof;

a rear panel having an outer face and an inner face, a groove defined in said inner face adjacent and parallel to the lower marginal edge of said rear panel, and a pair of grooves defined in said inner face adjacent and parallel to the vertical marginal edges thereof;

a bottom panel adapted to be received within respective grooves adjacent and parallel to the lower marginal edges of said front, side, and rear panels; and means for securing said side panels to said rear panel upon assembly, said securing means including a pair of first members connected along a marginal edge and extending from one another at substantially a right angle, a pair of second members connected along a marginal edge and extending from one another at substantially a right angle, means for interconnecting said first members to said second members to form panel receiving channels therebetween, and tabs on said second members extending toward said respective first members, said tabs being respectively adapted to be received in said grooves adjacent and parallel to said vertical marginal edges of said side panel and rear panel.

2. The invention of claim 1 wherein said means interconnecting said first and second members in an elongate web joined to and extending from the connection of said pair of first members to the connection of said pair of second members.

3. The invention of claim 2 wherein said pair of first members, said pair of second members, and said web are constructed as a single member.

4. The invention of claim 2 wherein said tabs are integral with and extend from the marginal edges of said respective second members opposite the connection of said pair of second members.

5. In a knock-down furniture drawer having front, rear, side, and bottom panels, means for interconnecting said panels to form a rigid construction, said means comprising:

a plurality of grooves respectively defined in said first, rear, and side panels adjacent and parallel to respective lower marginal edges of said front, rear, and side panels, said plurality of grooves adapted to receive said bottom panel;

a plurality of spaced apart female dovetail grooves defined in one face of said front panel adjacent and parallel to the vertical marginal edges of said front panel;

a vertical marginal edge of respective side panels having a male dovetail configuration complimentary to said spaced apart grooves of said front panel and adapted to be respectively received in said spaced apart grooves;

a plurality of grooves respectively defined in said rear panel adjacent and parallel to its vertical marginal edges and in said side panels adjacent and parallel to their vertical marginal edges opposite their complimentary configured vertical marginal edges; and retainers for securing said side panels to said rear panel upon assembly, said retainers including a pair of first members connected along a marginal edge and extending from one another at substantially a right angle, a pair of second members connected along a marginal edge and extending from one another at substantially a right angle, an elongate web joined to and extending from the connection of said pair of first members to the connection of said pair of second members to form panel receiving channels therebetween, and tabs on said second members extending toward said respective first members, said tabs being respectively adapted to be received in said grooves adjacent and parallel to said vertical marginal edges of said side panel and rear panel.

6. The invention of claim 5 wherein said pair of first members, said pair of second members, and said web are constructed as a single member.

7. The invention of claim 5 wherein said tabs are integral with and extend from the marginal edges of said respective second members opposite the connection of said pair of second members.

8. The invention of claim 7 wherein said retainers are resilient so as to provide an urging force against the respective faces of said side and rear panels to clamp said retainers to said panels whereby a rigid structure is accomplished.

* * * * *